US008680450B2

(12) United States Patent
Pritchard

(10) Patent No.: US 8,680,450 B2
(45) Date of Patent: Mar. 25, 2014

(54) ANTENNAS

(75) Inventor: Timothy John Pritchard, Welwyn Garden City (GB)

(73) Assignee: MBDA UK Limited, Stevenage, Hertfordshire (GB)

( * ) Notice: Subject to any disclaimer, the term of this patent is extended or adjusted under 35 U.S.C. 154(b) by 288 days.

(21) Appl. No.: 12/996,915

(22) PCT Filed: Jun. 11, 2010

(86) PCT No.: PCT/GB2010/050980

§ 371 (c)(1),
(2), (4) Date: Dec. 8, 2010

(87) PCT Pub. No.: WO2010/146387

PCT Pub. Date: Dec. 23, 2010

(65) Prior Publication Data

US 2011/0215190 A1 Sep. 8, 2011

(30) Foreign Application Priority Data

Jun. 19, 2009 (GB) ..... 0910662.6

(51) Int. Cl.

| | |
|---|---|
| ***F41G 7/20*** | (2006.01) |
| ***H01Q 19/19*** | (2006.01) |
| *F41G 7/00* | (2006.01) |
| *H01Q 19/00* | (2006.01) |

(52) U.S. Cl.

USPC ..... 244/3.16; 244/3.1; 244/3.15; 343/700 R; 343/705; 343/772; 343/781 R; 343/781 CA

(58) Field of Classification Search

USPC ..... 244/3.1–3.19; 343/700 R, 705, 708, 343/711–713, 753, 756, 757, 761, 767–772, 343/776, 779–781 CA, 832, 835–840, 907, 343/909, 910, 912–916; 359/618, 629, 634, 359/642, 726, 727, 728, 729

See application file for complete search history.

(56) References Cited

U.S. PATENT DOCUMENTS 2,823,612 A * 2/1958 Cox et al. ..... 244/3.16
3,733,133 A * 5/1973 Chapman ..... 244/3.16

(Continued)

FOREIGN PATENT DOCUMENTS

EP 0 281 042 9/1988
EP 1 083 626 A2 3/2001

(Continued)

OTHER PUBLICATIONS

UK Search Report dated Nov. 9, 2009.

(Continued)

*Primary Examiner* — Bernarr Gregory
(74) *Attorney, Agent, or Firm* — Scully, Scott, Murphy & Presser, PC

(57) ABSTRACT

A reflector 38 includes a mirrored surface 48 and a frequency selective surface 46. The frequency selective surface 46 is arranged to reflect radiation of a first frequency band 52 and allow radiation of a second frequency band 50 to pass. The mirrored surface 48 is arranged to reflect radiation of the second frequency band 50. In this manner, the focal power for radiation of the first frequency band 52 is independent to the focal power for radiation of the second frequency band 50. Accordingly, the design of optical components associated with the second frequency band 50 can be undertaken independently of those associated with the first frequency band 52 so as to achieve the optimised focusing for each frequency band.

9 Claims, 3 Drawing Sheets

(56) References Cited

U.S. PATENT DOCUMENTS

| | | | | |
|---|---|---|---|---|
| 3,989,947 | A * | 11/1976 | Chapman | 244/3.16 |
| 3,992,629 | A * | 11/1976 | Chapman | 244/3.16 |
| 5,161,051 | A * | 11/1992 | Whitney et al. | 244/3.16 |
| 5,214,438 | A | 5/1993 | Brusgard et al. | |
| 5,327,149 | A | 7/1994 | Kuffer | |
| 5,373,302 | A | 12/1994 | Wu | |
| 5,394,163 | A * | 2/1995 | Bullen et al. | 343/771 |
| 5,451,969 | A * | 9/1995 | Toth et al. | 343/781 CA |
| 6,129,307 | A * | 10/2000 | Deoms et al. | 244/3.16 |
| 6,140,978 | A * | 10/2000 | Patenaude et al. | 343/909 |
| 6,169,524 | B1 * | 1/2001 | Wu et al. | 343/910 |
| 6,175,333 | B1 * | 1/2001 | Smith et al. | 343/770 |
| 6,208,316 | B1 * | 3/2001 | Cahill | 343/909 |
| 6,268,822 | B1 * | 7/2001 | Sanders et al. | 343/753 |
| 6,285,332 | B1 * | 9/2001 | Chandler | 343/756 |
| 6,445,351 | B1 | 9/2002 | Baker et al. | |
| 6,483,474 | B1 * | 11/2002 | Desargant et al. | 343/781 CA |
| 6,512,494 | B1 * | 1/2003 | Diaz et al. | 343/909 |
| 6,545,645 | B1 * | 4/2003 | Wu | 343/781 P |
| 6,606,066 | B1 | 8/2003 | Fawcett et al. | |
| 6,670,932 | B1 * | 12/2003 | Diaz et al. | 343/909 |
| 6,795,034 | B2 * | 9/2004 | Lyerly et al. | 343/781 CA |
| 7,082,001 | B2 * | 7/2006 | Vizgaitis | 359/729 |
| 7,183,966 | B1 | 2/2007 | Schramek et al. | |
| 7,333,271 | B2 * | 2/2008 | Jackson | 359/634 |
| 7,639,206 | B2 * | 12/2009 | Behdad | 343/909 |
| 2004/0008148 | A1 | 1/2004 | Lyerly et al. | |
| 2005/0225881 | A1 | 10/2005 | Vizgaitis | |

FOREIGN PATENT DOCUMENTS

| | | | |
|---|---|---|---|
| EP | 1 362 385 | A1 | 11/2003 |
| GB | 1 370 669 | | 10/1974 |
| GB | 2 448 077 | A | 10/2008 |

OTHER PUBLICATIONS

International Preliminary Report on Patentability and Written Opinion dated Jan. 5, 2012 from related International Application PCT/GB2010/050980.

Cornbleet, S., A New Design Method for Phase-Corrected Reflectors at Microwave Frequencies, Proceedings of the Institution of Electrical Engineers, Sep. 12, 1960, pp. 179-189 vol. 107, No. 12.

Ueno, K. et al., Low-Loss KA-Band Frequency Selective Subreflector, Electronics Letters, Jun. 20, 1991, p. 1155, vol. 27, No. 13.

Derneryd, A. et al., Dichroic Antenna Reflector for Space Applications, Ericsson Review (Incl. On), Jan. 1, 1991, pp. 22-33, vol. 68, No. 2.

International Search Report mailed Dec. 8, 2010 in corresponding PCT Application No. PCT/GB2010/050980.

* cited by examiner

ANTENNAS

BACKGROUND OF THE INVENTION

The present invention relates to a reflector and an antenna system, in particular to a reflector and an antenna system arranged to transmit and/or receive radiation of two frequency bands. Such a reflector or antenna system may be used within a seeker system of a missile.

According to EP1362385, a missile seeker arrangement can include a Cassegrain antenna system mounted within the radome of the missile. Such a Cassegrain antenna incorporates a parabolic shaped primary reflector and a hyperbolic shaped secondary reflector.

The secondary reflector is mounted to the primary reflector via a support. The support is made from a dielectric material having a thickness selected to minimise transmission loss.

The primary reflector is mounted on a gimbal arrangement so as to be articulated about either roll or pitch axes with respect to the missile. In this manner a greater field of view can be provided for the seeker arrangement.

The secondary reflector is formed from a mirror surface and is designed to reflect radiation incident thereon to either the primary reflector for transmission or to reflect radiation received from the primary reflector to a receiver or detector section via a focusing lens.

The missile seeker arrangement is arranged to receive and/or transmit both radio frequency and infra-red frequency bands simultaneously to make optimum use of the finite aperture available. Such a system is known as a dual mode radar seeker.

One problem introduced when a Cassegrain antenna is used within such a dual mode seeker is that complicated optical design and components are required in order to correct aberrations induced on the infra-red frequency band by components associated with the radio frequency band.

SUMMARY OF THE INVENTION

According to an aspect of the invention, a reflector, includes a mirrored surface, a frequency selective surface associated with the mirrored surface, wherein the frequency selective surface is arranged to reflect radiation of a first radio frequency band and allow radiation of a second frequency band to pass, and wherein the mirrored surface is arranged to reflect radiation of the second frequency band, thereby the focal power for radiation of the first radio frequency band is independent to the focal power for radiation of the second frequency band.

In this manner, the design of optical components for the second frequency band can be undertaken independently of those for the first radio frequency band to achieve the optimised focusing for each frequency band. For example, the mirrored surface can be arranged to aid correction of aberrations associated with the second frequency band and to provide a different focal power to that associated with the first radio frequency band.

The second frequency band may include two or more sub-bands of radiation so as to provide a multi-spectral reflector.

The mirror may be a Mangin type mirror and lens arranged to aid correction of aberrations associated with the second frequency band.

The frequency selective surface may be mounted on a convex surface of a meniscus lens, the mirrored surface may be mounted on a concaved surface of the meniscus lens and the meniscus lens may be arranged to aid correction of aberrations associated with the second frequency band. Alternatively, the frequency selective surface may be mounted on a convex surface of a meniscus lens, the mirrored surface may be formed by a reflector element arranged with respect to the meniscus lens to form an air gap with a concaved surface of the meniscus lens and the meniscus lens may be arranged to aid correction of aberrations associated with the second frequency band.

The frequency selective surface may be a dichroic surface. The frequency selective surface may include an array of tripoles arranged in an equilateral triangular pattern. Alternatively, the frequency selective surface may include a grid arranged to reflect radiation of a first frequency band and to transmit radiation of a second frequency band. The dichroic surface may be arranged to reflect circularly polarised radiation.

The first radio frequency band may the Ka band of frequencies. The second frequency band include within the electro-optic range of frequencies. The electro-optic frequencies in this instance refer to the infra-red and visual spectral bands. The second frequency band may include laser frequencies, for example a wavelength of about 1064 nm. The second frequency band may include the infra-red wavelength range of between 8 and 14 microns. Alternatively, a multi-spectral type reflector may be arranged to reflect multiple sub-bands of radiation, for example radiation in the bands 3 to 5 microns and 8 to 14 microns. Accordingly, the second frequency band may include a plurality of sub-bands of frequencies.

The reflector may be arranged to be incorporated within a Cassegrain antenna system as a secondary reflector.

An antenna system may include a reflector as herein described wherein the reflector may be employed as a secondary reflector.

A missile seeker may include a reflector as herein described.

BRIEF DESCRIPTION OF THE DRAWINGS

The invention will now be described, by way of example only, with reference to the accompanying drawings, in which.

DETAILED DESCRIPTION OF THE INVENTION

Millimeter wave radar seekers provide a strong capability in the engagement of surface based targets. Performance can be enhanced by augmenting such radar seekers with a complementary infra-red sensor, especially when the radar seeker is to be used in short range, terminal operations where near visual target confirmation is required prior to engagement with the target.

As there is a limited space within a missile, it is necessary to incorporate a Cassegrain antenna system within the missile head to provide the necessary focal length to correctly receive both radar and infra-red frequencies within the size constraints of the missile. Furthermore, to house components associated with transmission and/or reception of both infra-red and radio frequency bands within the missile, it is necessary for the radar seeker to be designed in such a manner that infra-red and radio frequency channels share the primary and secondary reflector elements of the Cassegrain antenna system in a dual mode configuration.

A Cassegrain antenna when used within a dual mode seeker requires complicated optical design and components in order to correct for aberrations induced on the infra-red frequency band by components associated with the radio frequency band.

Figure 1:
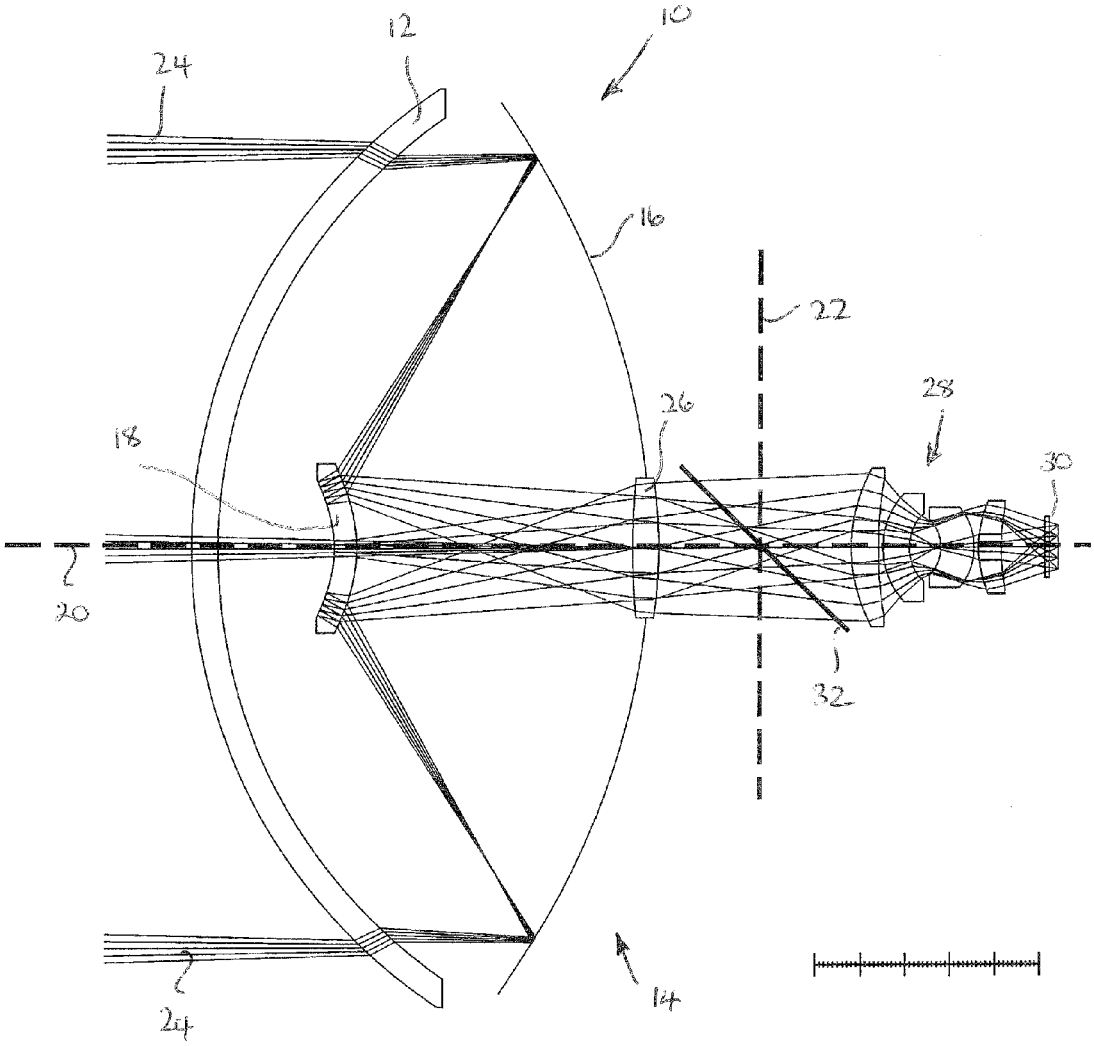
FIG. 1 illustrates a Cassegrain type antenna system including a reflector according to the present invention.

Referring to FIG. 1, a missile seeker 10 includes a Forward Looking Infra-red radome 12 formed from a material that is compatible with both the radio frequency band and the selected infra-red frequency band to be transmitted or received by the seeker 10. For example, the radome 12 can be manufactured from Zinc Sulphide material.

A Cassegrain antenna system 14, within the missile seeker 10, includes a parabolic shaped primary reflector 16 mounted in a spaced relationship with and facing a secondary reflector 18. The secondary reflector 18 is mounted to the primary reflector 16 via a support structure, not illustrated for clarity, such that the primary 16 and secondary 18 reflectors are retained in the correct spatial arrangement. The support is made from a dielectric material having a thickness selected to minimise transmission loss of radiation being transmitted or received by the Cassegrain antenna system 14. In an alternative embodiment, the secondary reflector could be fixed relative to the missile body and combined with a steerable primary reflector.

The primary reflector 16 is also mounted via a suitable gimbal arrangement, not shown, such that the primary reflector 16, and hence the secondary reflector 18, can be rotated about both a roll axis 20 and pitch axis 22 arranged orthogonally to one another.

In operation, radiation 24 including infra-red within the range 8 and 14 microns enters the missile via the radome 12 and is reflected by the primary reflector 16 towards the secondary reflector 18. The secondary reflector 18 is dimensioned such that the radiation is then reflected through a focussing lens 26 to an infra-red optical arrangement 28 arranged to focus received infra-red radiation on to an infra-red detector 30.

Furthermore, the radiation 24 received at the primary reflector 16 also includes radio frequency signals in the Ka band. Such radio frequency signals are also reflected to the secondary reflector 18 and via the focussing lens 26 to a suitable radio frequency detector, not illustrated.

A dichroic beam splitter 32 is arranged between the focussing lens 26 and the infra-red optical arrangement 28 so as to allow common or dual use of the Cassegrain antenna system 14 by both infra-red radiation and radio frequency radiation. The beam splitter comprises a free standing wire grid including a frame carrying a first set of parallel wires at a regular pitch and a second set of parallel wires lying in the same plane, but orthogonal to the first set of parallel wires. The normal of the plane wires is inclined at 45 degrees to a propagation axis for incident radiation 24. Accordingly, a majority of incident radiation 24 associated with the radio frequency band will be deflected through 90 degrees by the beam splitter 32 and directed to the radio frequency detector. Furthermore, the majority of the infra-red radiation will pass undeflected through the beam splitter 32 to the infra-red optical arrangement 28 and hence the infra-red detector 30. In this manner, the beam splitter 32 allows more than one spectral band of radiation to be received at the same time, the different spectral bands being split off and directed to the appropriate sensor for processing to derive the information carried by each spectral band of radiation. The beam splitter 32 does not include a substrate that refracts infra-red radiation, thereby mitigating asymmetric infra-red aberrations. The beam splitter 32 is also arranged to reflect the majority of incident radiation 24 associated with the radio frequency band to be transmitted out of the missile seeker 10 via the Cassegrain antenna system 14. Alternatively, if aberration control requirements are not so stringent, the dichroic beam splitter can include a substrate arranged to carry a dichroic tripole array. Such a tripole array is described in further detail below with reference to FIG. 4.

Figure 2:
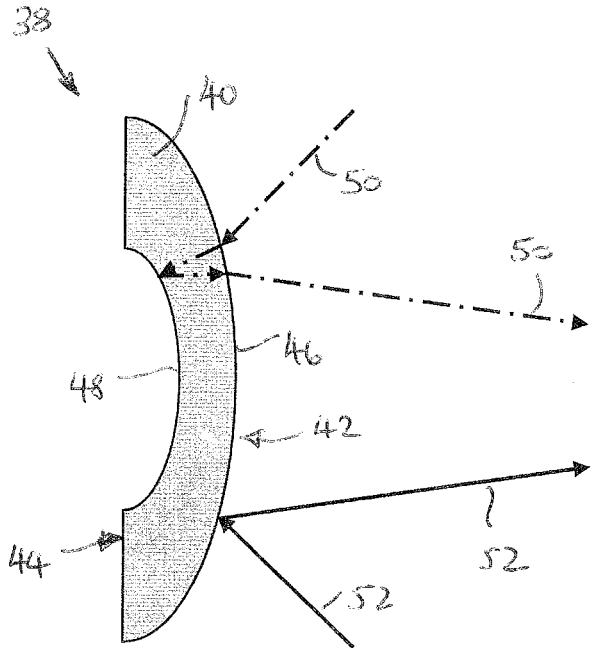
FIG. 2 illustrates the operation of a first embodiment of the reflector according to the present invention.

Referring to FIG. 2, in a first embodiment of a secondary reflector 38 is formed from a meniscus lens 40 that has aspheric profiles defining a convex front surface 42 and a concaved back surface 44. The meniscus lens 40 can be formed from Germanium or other material that is selected to allow infra-red radiation to propagate therethrough. The front surface 42 is provided with a frequency selective dichroic surface 46 formed from a material selected to reflect radio frequency radiation and to allow infra-red radiation to propagate therethrough. The back surface 44 is provided with a mirrored surface 48 arranged to reflect infra-red radiation.

In operation, incident infra-red radiation 50 passes through the dichroic surface 46 and propagates through the meniscus lens 40 and is then reflected by the mirrored surface 48 out of the meniscus lens 40 via front surface 42. Incident radio frequency radiation 52 is reflected away from the meniscus lens 40 by the dichroic surface 46. In this manner, the incident infra-red radiation and incident radio frequency radiation traverse different paths thereby creating a separation of the focal powers required for each band of radiation. Accordingly, an optical designer is provided with an independent choice of focal power in the infra-red frequency band compared to the radio frequency band. This is beneficial as it is easier to achieve infra-red image aberration correction for an infra-red Cassegrain antenna system that has a different effective focal length. This is important when good image quality is required such as in an imaging infra-red mode in as seeker. It is also useful to independently control the field of view and tracking characteristics of a laser spot tracker mode, whilst achieving good performance for the radio frequency band. The secondary reflector 38 simplifies aberration correction in the infra-red radiation channel caused by the optical components associated with the radio frequency channel and thus improves image quality achievable in the infra-red mode sharing a common aperture with a radio frequency band. Accordingly, there can be a reduction in the number and dimension of optical components required to provide the aberration correction. Thus the secondary reflector 38 maximizes the exploitation of a finite aperture of a Cassegrain antenna system for use in a missile seeker.

Figure 3:
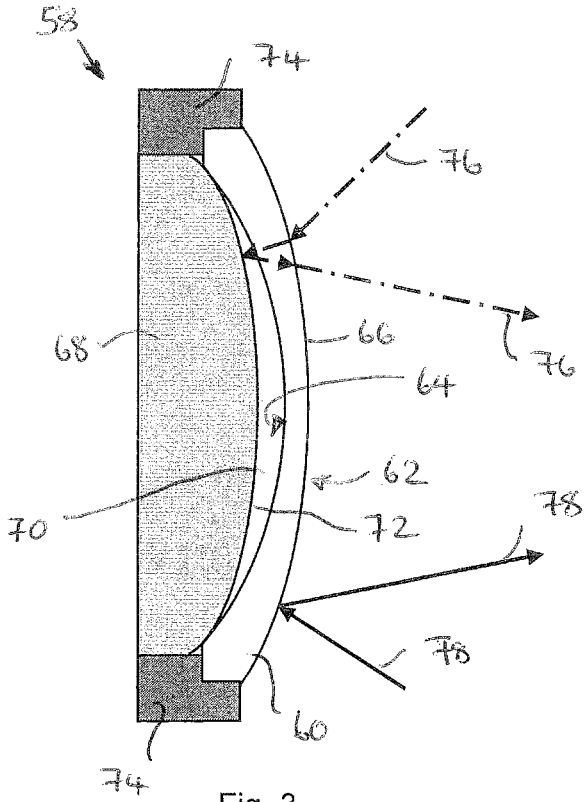
FIG. 3 illustrates the operation of a second embodiment of the reflector according to the present invention.

Referring to FIG. 3, in an alternative to the embodiment described with reference to FIG. 2, a secondary reflector 58 is formed from a meniscus lens 60 that has aspheric profiles defining a convex front surface 62 and a concaved back surface 64. The meniscus lens 60 can be formed from Germanium or other material that is selected to allow infra-red radiation to propagate therethrough. The front surface 62 is provided with a frequency selective dichroic surface 66 formed from a material selected to reflect radio frequency radiation and to allow infra-red radiation to propagate therethrough. A reflector element 68 is provided behind and in spaced relationship with the back surface 64 so as to form a cavity 70. The reflector element 68 is provided with a mirrored surface 72 arranged to reflect infra-red radiation. The meniscus lens 60 and reflector element 68 are retained with respect to one another by a suitable annular mounting component 74.

In operation, incident infra-red radiation 76 passes through the dichroic surface 66 and propagates through the meniscus lens 60, crosses the cavity 70 and is then reflected by the mirrored surface 72 back through the meniscus lens 60 and exits the meniscus lens 60 via front surface 62. Incident radio frequency radiation 78 is reflected away from the meniscus lens 60 by the dichroic surface 66. In this manner, the incident infra-red radiation and incident radio frequency radiation traverse different paths thereby creating a separation of the focal powers required for each band of radiation.

Figure 4:
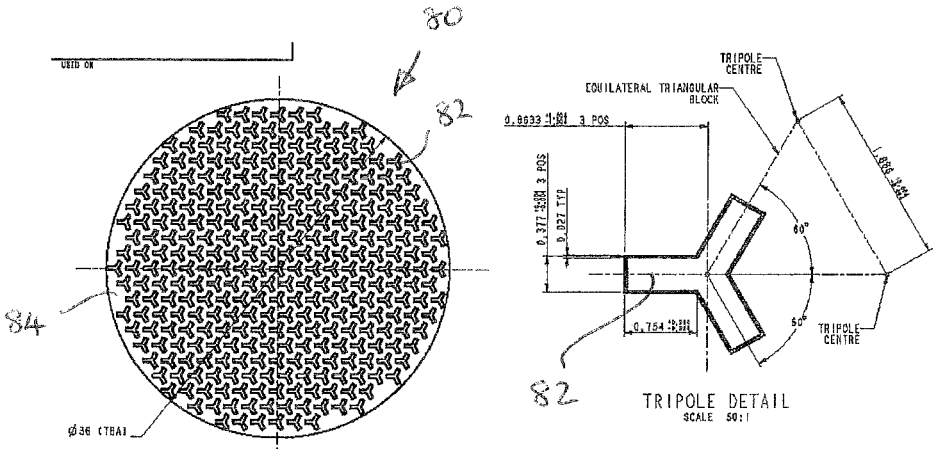
FIG. 4 illustrates an array of tripoles on a surface of the reflector as shown in FIG. 2 or 3.

Referring to FIG. 4, the dichroic surface 80 can comprise either an array of tripoles 82, for example three-legged loaded dipoles, or a two dimensional grid, for example a grid similar in construction to the beam splitter 32 described with reference to FIG. 1, that is deposited onto the convex surface of a meniscus lens 84 in the arrangements such as those described with reference to either FIG. 2 or 3. For a dual mode seeker application, circular polarisation of the radio frequency radiation is desirable so the preferred array of hollow tripoles 82 is arranged in an equilateral triangle configuration. Such tripoles reflect circularly polarised radio frequency waves and if made hollow they minimize blockage presented to the infra-red frequency band by allowing the infra-red radiation to pass through the middle, whilst retaining the radio frequency properties. A tripole configuration is more efficient at reflecting circularly polarised radio frequency radiation and minimising infra-red radiation blockage when compared with a rectangular grid configuration. In addition, the triangular grid formation provided by the tripoles affords a more stable resonance frequency response as a function of incident angle than that provide by a grid formation.

The invention claimed is:

1. A Cassegrain antenna system comprising a primary reflector and a secondary reflector, the secondary reflector comprising:

a mirrored surface;

a frequency selective surface associated with the mirrored surface;

wherein the frequency selective surface is configured to reflect received radiation of a first radio frequency band and allow received radiation of a second frequency band to pass, the second frequency band including the electro-optic range of frequencies;

and wherein the mirrored surface is configured to reflect the received radiation of the second frequency band;

thereby the focal power for received radiation of the first radio frequency band is independent of the focal power for received radiation of the second frequency band.

2. A Cassegrain antenna system, as claimed in claim 1, wherein the mirrored surface is a Mangin mirror configured to aid correction of aberrations associated with the second frequency band.

3. A Cassegrain antenna system, as claimed in claim 1, wherein the secondary reflector further comprises a meniscus lens, the frequency selective surface is mounted on a convex surface of the meniscus lens, the mirrored surface is mounted on a concaved surface of the meniscus lens and the meniscus lens is configured to aid correction of aberrations associated with the second frequency band.

4. A Cassegrain antenna system, as claimed in claim 1, wherein the secondary further comprises: a meniscus lens having a convex surface and a concaved surface; and a reflector element, wherein the frequency selective surface is mounted on the convex surface of the meniscus lens, and the mirrored surface is provided by the reflector element, and wherein the reflector element forms an air gap with the concaved surface of the meniscus lens and the meniscus lens is configured to aid correction of aberrations associated with the second frequency band.

5. A Cassegrain antenna system, as claimed in claim 1, wherein the frequency selective surface is a dichroic surface.

6. A Cassegrain antenna system, as claimed in claim 1, wherein the frequency selective surface includes an array of tripoles arranged in an equilateral triangular pattern.

7. A Cassegrain antenna system, as claimed in claim 1, wherein the frequency selective surface includes a grid configured to reflect radiation of the first radio frequency band and transmit radiation of the second frequency band.

8. A Cassegrain antenna system, as claimed in claim 1, wherein the second frequency band includes a plurality of sub-bands of frequencies.

9. A missile seeker comprising a Cassegrain antenna system comprising a primary reflector and a secondary reflector, the secondary reflector comprising:

a mirrored surface;

a frequency selective surface associated with the mirrored surface;

wherein the frequency selective surface is configured to reflect received radiation of a first radio frequency band and allow received radiation of a second frequency band to pass, the second frequency band including the electro-optic range of frequencies;

and wherein the mirrored surface is configured to reflect the received radiation of the second frequency band;

thereby the focal power for received radiation of the first radio frequency band is independent of the focal power for received radiation of the second frequency band.

* * * * *